United States Patent [19]

Yamazaki et al.

[11] Patent Number: 4,867,100

[45] Date of Patent: Sep. 19, 1989

[54] DEVELOPING APPARATUS

[75] Inventors: Yoshio Yamazaki; Kazuhiko Uneme; Takeichi Shimada, all of Hachioji, Japan

[73] Assignee: Konishiroku Photo Industry Co., Ltd., Tokyo, Japan

[21] Appl. No.: 219,862

[22] Filed: Jul. 12, 1988

Related U.S. Application Data

[63] Continuation of Ser. No. 880,816, Jul. 1, 1986, abandoned.

[30] Foreign Application Priority Data

Jul. 3, 1985 [JP] Japan ..... 60-144830

[51] Int. Cl.[4] ..... G03G 15/09

[52] U.S. Cl. ..... 118/657; 118/658; 118/690; 355/253; 355/260; 355/208; 355/246

[58] Field of Search ..... 118/690, 691, 657, 658, 118/688, 689; 355/3 DD, 14 D

[56] References Cited

U.S. PATENT DOCUMENTS

| | | | |
|---|---|---|---|
| 3,941,084 | 3/1976 | Kurita | 118/657 |
| 4,193,376 | 3/1980 | Hamaguchi et al. | 430/122 |
| 4,370,049 | 1/1983 | Kuge et al. | 355/3 DD |
| 4,496,240 | 1/1985 | Yamashita et al. | 118/688 X |
| 4,591,261 | 5/1986 | Saruwatari et al. | 355/3 DD |
| 4,615,606 | 10/1986 | Nishikawa | 355/3 DD |
| 4,659,211 | 4/1987 | Oka | 118/657 X |

FOREIGN PATENT DOCUMENTS

| | | | |
|---|---|---|---|
| 0009157 | 1/1983 | Japan | 118/657 |
| 0086579 | 5/1983 | Japan | 355/3 DD |
| 2069879 | 9/1981 | United Kingdom | 118/657 |

*Primary Examiner*—Shrive Beck
*Assistant Examiner*—Alain Bashore
*Attorney, Agent, or Firm*—Jordan B. Bierman

[57] ABSTRACT

The present invention provides a compact developing apparatus, wherein there is provided a developer container having first magnetic brush carrier for developing the image information at one side thereof and a developing replenishing container at other side thereof, the developing container and the developing replenishing container are so constructed to be one body. The partition wall is located between the both containers and has a opening portion to communicate the both containers. Second magnetic brush carrier is provided at the opening portion to replenish the developer from the developer replenishing container to the developer container. The second magnetic brush carrier can be operated automatically in accordance with the concentration of the developer.

10 Claims, 1 Drawing Sheet

DEVELOPING APPARATUS

This application is a continuation of application Ser. No. 880,816 filed July 1, 1986, now abandoned.

BACKGROUND OF THE INVENTION

The present invention relates to a developing apparatus of an electrophotographic equipment such as an electrophotographic copying machine and more particularly to a developing apparatus wherein a developer container having therein a magnetic brush carrier and a developer replenishing container are united in one.

For developing electrostatic latent images formed on the image carrier such as a photoreceptor in the form of a drum or a belt in an electrophotographic equipment such as an electrophotographic copying machine, for example, there is generally and widely used a developing apparatus wherein a magnetic developer such as a single-component developer consisting only of magnetic toner or a two-component developer consisting of magnetic carrier and non-magnetic toner is used and a magnetic feeder that conveys aforesaid developer in the form of a brush formed thereon by magnetic effect thereon to the developing area is provided. (Whereinafter the magnetic feeder is called as a magnetic brush carrier.)

Aforesaid developing apparatus is required to be equipped with a developer container having a magnetic brush carrier and with a developer replenishing container having a means for replenishing developer to aforesaid developer container and to be constituted so that aforesaid means for replenishing developer is actuated depending on the amount of developer or toner concentration both in the developer container. The developing apparatus is further required to be small in size, light in weight and simple in structure for the easy maintenance or the quick attaching and detaching operations. In aforesaid developing apparatus, however, it is difficult to make it small in size, light in weight and simple in structure because the developer replenishing container is provided on the upper portion of the developer container so that the supplying port through which the developer is replenished is positioned above the bottom of the developer container and, in addition to that, a developer-distributing means is provided on the developer replenishing container or on the developer container so that the developer can be replenished evenly in the direction of the axis of the magnetic brush carrier. The developing apparatus disclosed in Japanese Patent Examined Publication No. 42389/1980, for example, will be explained next. Aforesaid developing apparatus is so constructed that a developer container and a developer replenishing container are united in one body, wherein the developer container has a magnetic brush carrier and the developer replenishing container has both a screw for the use of developer-conveyance and a ratchet wheel for replenishing a predetermined amount in which the screw and the ratchet wheel both are arranged in parallel to aforesaid magnetic brush carrier. Further, the developing apparatus is so constituted that, the developer in a developer supplier provided at the upper portion on one end of the developer replenishing container is supplied to the developer replenishing container by means of the screw for the use of developer-conveyance and a screw cover, wherein the screw cover is arranged at front side along the direction of the axis of aforesaid screw and has a tapered top face that gradually reduces its dimension in the proceeding direction of the screw so that the developer is evenly dispersed in the direction of the axis of the screw. For replenishing a predetermined amount of the developer to the developer container, the ratchet wheel provided at the supplying port of the developer replenishing container positioned above the bottom of the developer container is rotated. Aforesaid developing apparatus is capable of replenishing the developer into the developer container while dispersing the developer uniformly in the axial direction of the magnetic brush carrier, but it has disadvantages that the constitution for aforesaid uniform dispersion is complicated and the developing apparatus itself tends to be bulky in the vertical direction because the developer replenishing container is located at the upper portion of the developer container. Thus the maintenance or mounting and dismounting operations of the developing apparatus is not easy and is not satisfactory for practical use.

BRIEF DESCRIPTION OF THE DRAWINGS

FIG. 2 is an enlarged view of the key portion in FIG. 1, while

SUMMARY OF THE INVENTION

An object of the invention is to solve aforesaid problems in the past and to provide a developing apparatus wherein a developer container that is small in size, light in weight and simple in structure and a developer replenishing container are united in one.

The developing apparatus of the present invention comprises, in its constitution, a developer container wherein a magnetic brush carrier for the development is provided on the front side thereof, a developer replenishing container provided solidly on the back side of aforesaid developer container so that the bottom parts of both the developer container and the developer replenishing container are on the same level, a partition wall that separates aforesaid developer container from the developer replenishing container and has thereon an opening through which the developer container communicates with the developer replenishing container in the vicinity of its bottom portion, and a magnetic brush carrier for replenishing the developer arranged about at said opening portion.

DETAILED DESCRIPTION OF THE PREFERRED EMBODIMENTS

The invention will be explained in detail referring to an example.

Figure 1:
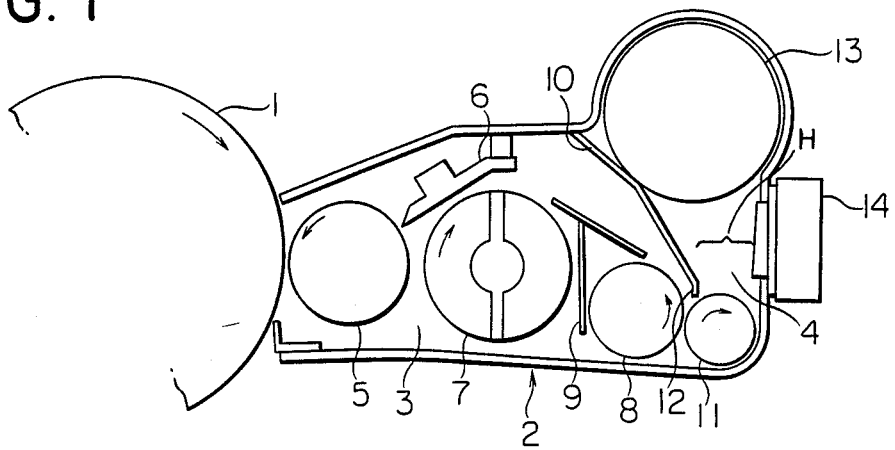
FIG. 1 shows a schematic diagram of an example of the invention.
Figure 2:
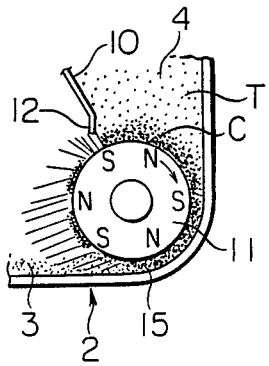

FIG. 1 is a schematic diagram of a magnetic brush type developing apparatus in an electrophotographic copying machine for explaining the example and FIG. 2 is an enlarged schematic view of key parts for explaining the operation of the magnetic brush type developing apparatus shown in FIG. 1. In FIGS. 1 and 2, notation 1 represents a drum-shaped photoreceptor which carries an image information, 2 represents a magnetic brush type developing apparatus, 3 represents a developer container (first container means), 4 is a developer replenishing container (second container means), 5 is a first feeder means which is, in this example, a magnetic brush carrier for the development that conveys a developer containing a magnetic component such as two-component developer consisting of magnetic carrier particles and non-magnetic toner to the developing area, 6 is a regulating plate that controls the height of the magnetic brush, i.e., ear of developer formed on magnetic brush carrier 5, 7 is a primary agitating member, 8 is an auxiliary agitating member and 9 is a partition plate for enhancing the efficiency of developer agitation made by aforesaid agitating members 7 and 8. The notation 10 represents a partition wall member that separates developer container 3 from developer replenishing container 4 and has an opening H which causes the developer container 3 and the developer replenishing container 4 to communicate each other preferably in the vicinity of their bottoms and 11 is a replenishing roller as second magnetic feeder means which is a magnetic brush carrier for replenishing the developer and include a roller-shaped magnetic substance arranged being rotatable and being in parallel with magnetic brush carrier 5 for the development and it is so constituted that replenishing roller 11 is actuated by the signal from an unillustrated toner concentration controlling device. The notation 12 is a regulator member arranged at the lower end of partition wall 10 and regulates the height of a magnetic brush of the developer formed on replenishing roller 11. 13 is a toner cartridge that contains toner to be replenished and is supported rotatably. 14 is a detector that detects the residual quantity of toner in developer replenishing container 4 and 15 is a toner conveyance port. Notation T represents toner while C represents carrier. Incidentally, according to preferred embodiment, the average particle size of toner T is 9–12 μm and carrier C consists iron powder, ferrite or insulating resin-coated iron powder or ferrite whose average particle size is 60–120 μm. It is preferable that auxiliary agitating plate 8 is located closely to but without touching replenishing roller 11.

In the magnetic brush type developing apparatus 2 shown in FIG. 1, toner T in developer replenishing container 4 is replenished into developer container 3 as follows. Developer in developer container 3 are attracted on magnetic brush carrier 5 for the development use and are transported to the developing area where toner T in aforesaid developer are mainly consumed for developing electrostatic latent images formed on photoreceptor 1, thus the toner concentration in the developer. When aforesaid toner concentration goes down to the lower limit value, signals are sent out from the unillustrated toner concentration control device and replenishing roller 11 is rotated. When replenishing roller 11 is rotated, carrier C attracted onto replenishing roller 11 in developer container 3 is turned by replenishing roller 11 as shown in FIG. 2. Carrier C attracted onto replenishing roller 11 are regulated, while they are turning, by regulator plate 12 to a prescribed height and then moved into developer replenishing container 4 where a part of toner T is adsorbed on and supported by carrier C and brought into developer container 3 through conveyance port 15. The toner T thus brought into developer container 3 is agitated by auxiliary agitating plate 8, partition plate 9 and primary agitating plate 7 successively and conveyed to magnetic brush carrier 5 for development. Toner T acquires electrical charge, through aforesaid agitation, in polarity is opposite to that of electrostatic latent images formed on photoreceptor 1. When toner T are replenished in the manner mentioned above and the toner concentration in the developer in developer container 3 reaches a predetermined value, replenishing roller 11 stops rotating. When replenishing roller 11 stops rotating, a clearance portion between communicating opening H such as conveyance port 15 and the replenishing roller is filled up with carrier C attracted on replenishing roller 11, therefore, toner T for replenishment do not leak through aforesaid clearance portion. Incidentally, toner T conveyed by replenishing roller 11 through conveyance port 15 is replenished evenly in the axial direction of replenishing roller 11 because the height of the magnetic brush is regulated to a prescribed height over the entire length of replenishing roller 11 in its axial direction. It is, therefore, possible to make the toner concentration of the developer in developer container 3 uniform mostly over the entire length of magnetic brush carrier 5 for the development in its axial direction.

Being able to replenish uniformly the prescribed amount of toner T by means of the replenishing roller as stated above, the magnetic brush type developing apparatus of the present example does not require a developer-dispersing means separately and is small in size, light in weight and simple in structure compared with conventional ones because the developer container and the developer replenishing container are united in one so that their bottom portions are on the same level, thus the maintenance or the mounting and dismounting operation of the developing apparatus can easily be done.

Figure 3:
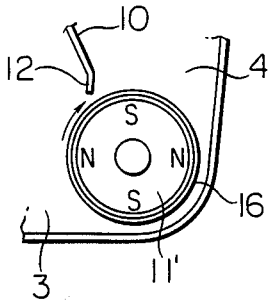
FIG. 3 through FIG. 5 are explanatory drawings of the variations for the key portion in FIG. 2.
Figure 4:
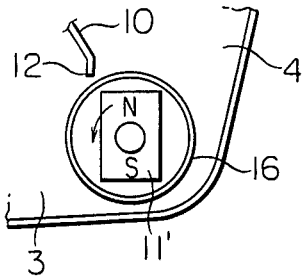
Figure 5:
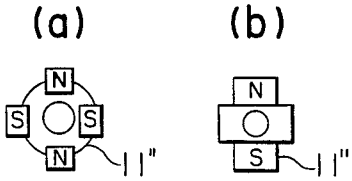

Incidentally, the replenishing roller may also be a combination of a magnet and a non-magnetic sleeve which are relatively rotatable as shown in FIG. 3, wherein magnet 11' is fixed and non-magnetic sleeve 16 is arranged rotatably in the direction of an arrow, or the one as shown in FIG. 4, wherein non-magnetic sleeve 16 is fixed and magnetic substance 11' is arranged rotatably in the direction of an arrow. Further, the magnetic substance of the replenishing roller may be one wherein an N-pole and an S-pole are magnetized reciprocally on the same circumference of a circle or one having the external shape other than a roller form as shown by the notation 11'' in (a) and (b) of FIG. 5. In the present example, single-component developers consisting only of magnetic toners can be used and the magnetic brush carrier for the development can either be one that functions rubbing a photoreceptor or one that functions without rubbing a photoreceptor.

The developing apparatus of the invention does not require a developer-dispersing means separately because the developer container and the developer replenishing container are united in one so that their bottom portions are on the same level and the magnetic brush carrier for replenishing developer is arranged in the communicating opening on the partition wall that separates the developer container from the developer replenishing container. Compared with the conventional developing apparatus, therefore, the developing apparatus of the invention can be small in size, light in weight and simple in structure and the maintenance or the mounting and dismounting operation of the developing apparatus can easily be done. Further, the developing apparatus of the invention is suitable especially for the electrophotographic equipment employing color toners wherein the developing apparatus needs to be mounted or dismounted frequently.

What is claimed is:

1. A developing apparatus for producing a toner image comprising:

(a) a first container means for storing a developer, said developer containing a toner and magnetic carrier particles;

(b) a first feeder means for feeding the developer from (a) to a predetermined position for producing the toner image, said first feeder means being disposed at one side of (a);

(c) a second container means for storing a toner, said toner being used to replenish (a), said second container means being disposed at another side of (a);

(d) a partition wall member disposed between (a) and (c), said partition wall member having an open portion forming a passage between (a) and (c);

(e) a magnetic second feeder means at said open portion for attracting the magnetic carrier particles stored in said (a) thereto in the form of a magnetic brush so that the passage between (a) and (c) is substantially blocked by said magnetic brush, said magnetic second feeder means being capable of moving the magnetic brush between (c) and (a) through said passage so that the toner from (c) replenishes (a), (f) an agitating member disposed in (a), said agitating member agitating the toner and the magnetic carrier particles so as to form a uniformly mixed developer; and (g) a toner concentration control means for operating said magnetic second feeder means so as to start or stop movement of the magnetic brush in accordance with toner concentration of the developer.

2. The developing apparatus of claim 1 wherein said second container means is disposed opposite to said first feeder means across both said first container means and said partition wall member and is so constructed to be one body with said first container means, wherein the bottom portion of both said first container means and said second container means are constructed to be same level with each other, and wherein said opening portion is positioned at lower part of said partition wall member.

3. The developing apparatus of claim 1, wherein said second magnetic feeder means utilizes a magnetic brush formed on a cylindrical roller member including therein a magnet member, said magnetic brush being formed by a magnetic toner or a combination of a magnetic carrier particle and a non-magnetic toner.

4. The developing apparatus of claim 1, wherein both said first feeder means and said second magnetic feeder means utilize respectively a magnetic brush formed on a cylindrical roller member including therein a magnet member, said magnetic brush being formed by a magnetic toner or a combination of a magnetic carrier particle and a non-magnetic toner.

5. The developing apparatus of claim 4, wherein both said cylindrical roller members are disposed to be parallel with each other in the axial direction thereof.

6. The developing apparatus of claim 3, wherein there is further provided a regulator member for regulating the height of said magnetic brush formed on said second magnetic feeder.

7. The developing apparatus of claim 3, wherein said second magnetic feeder means is controlled to operate in accordance with the command of a toner concentration control means.

8. The developing apparatus of claim 5, wherein said second magnetic feeder means comprises a magnetic substance and a non-magnetic sleeve member, said non-magnetic sleeve member surrounds said magnetic substance, said magnetic substance and said non-magnetic sleeve member are so constructed that relative rotating motion takes pace to carry the developer.

9. The developing apparatus of claim 5, wherein said magnetic member comprises a south pole and a north pole which are located on same circumference and positioned alternative with each other.

10. The developing apparatus of claim 1 wherein a remaining opening portion between said opening portion and said magnetic second feeder means is closed by said magnetic brush formed on said magnetic feeder means when said magnetic second feeder means is not replenishing said developer, whereby said developer is prevented from leaking from said second container means to said first container means.

* * * * *